US008915023B2

(12) United States Patent
Whiting et al.

(10) Patent No.: US 8,915,023 B2
(45) Date of Patent: Dec. 23, 2014

(54) SAFETY HATCH SYSTEM

(71) Applicant: SafePro, L.P., Dallas, TX (US)

(72) Inventors: Richard J. Whiting, Flower Mound, TX (US); Timothy Edward Rainey, Lewisville, TX (US)

(73) Assignee: SafePro, L.P., Dallas, TX (US)

( * ) Notice: Subject to any disclaimer, the term of this patent is extended or adjusted under 35 U.S.C. 154(b) by 0 days.

(21) Appl. No.: 14/013,223

(22) Filed: Aug. 29, 2013

(65) Prior Publication Data

US 2013/0340353 A1 Dec. 26, 2013

Related U.S. Application Data

(63) Continuation of application No. 12/537,112, filed on Aug. 6, 2009, now Pat. No. 8,522,487.

(60) Provisional application No. 61/188,086, filed on Aug. 6, 2008.

(51) Int. Cl.
*E06B 5/00* (2006.01)
*E05B 47/02* (2006.01)

(Continued)

(52) U.S. Cl.
CPC ..... *E06B 5/00* (2013.01); *E05Y 2400/614* (2013.01); *E05Y 2201/22* (2013.01);

(Continued)

(58) Field of Classification Search
CPC ..... E04B 7/16; E04B 7/163; E04B 7/166; E04D 13/00; E04D 13/0335; E04D 13/0351
USPC ..... 52/19–21, 72, 200; 49/13, 26, 28, 31, 49/394
See application file for complete search history.

(56) References Cited

U.S. PATENT DOCUMENTS 351,244 A 10/1886 Baines
385,531 A 7/1888 Shrader (Continued)

FOREIGN PATENT DOCUMENTS

DE 3423184 A1 1/1986
FR 2897624 A1 8/2007

(Continued)

OTHER PUBLICATIONS

International Search Report and Written Opinion in PCT Patent Application No. PCT/US09/53015, dated Jan. 7, 2010 (14 pages).

(Continued)

*Primary Examiner* — Mark Wendell
*Assistant Examiner* — Matthew J Smith
(74) *Attorney, Agent, or Firm* — Gardere Wynne Sewell LLP

(57) ABSTRACT

In one embodiment, an electronically controlled hatch system for safe ingress, egress, hazard detection, and methods thereof are provided to reduce or eliminate hazards to personnel, including protection of people above and below a scuttle hatch, access port, skylight or elevated deck. Said hatch system reduces the risk of falls while ascending or descending a ladder through an access port. In certain embodiments, severe weather, hazard, security, and other safety information are detected and transmitted to a central control unit for processing and regulating the opening and closing of a hatch covering the access port and/or raising and lowering a safety railing system based on said information and/or user input. Said hatch system may include an actuator and guides for automatically locking/unlocking and opening/closing a hatch, an actuator and guides for automatically raising/lowering a railing system, safety monitoring detectors/apparatuses, and a centralized controller.

28 Claims, 10 Drawing Sheets

(51) Int. Cl.

| | |
|---|---|
| ***E04B 7/16*** | (2006.01) |
| ***E05F 15/20*** | (2006.01) |
| ***E06C 7/00*** | (2006.01) |
| ***E06C 7/18*** | (2006.01) |
| ***E02D 29/14*** | (2006.01) |
| ***E02D 29/12*** | (2006.01) |
| ***E05F 15/12*** | (2006.01) |
| ***E04D 13/03*** | (2006.01) |
| ***E05C 1/14*** | (2006.01) |
| *E05B 47/00* | (2006.01) |

(52) U.S. Cl.

CPC ..... *E05Y 2800/42* (2013.01); *E05Y 2900/40* (2013.01); *E05B 2047/0058* (2013.01); *E05B 47/02* (2013.01); *E04B 7/16* (2013.01); *E05F 15/2015* (2013.01); *E06C 7/006* (2013.01); *E06C 7/182* (2013.01); *E02D 29/1463* (2013.01); *E06C 7/003* (2013.01); *E02D 29/127* (2013.01); *E05B 2047/0064* (2013.01); *E05Y 2900/612* (2013.01); *E05F 15/124* (2013.01); *E05F 15/2007* (2013.01); *E04D 13/0335* (2013.01); *E05C 1/14* (2013.01)

USPC ..... 52/19; 52/72

(56) References Cited

U.S. PATENT DOCUMENTS

| | | | | |
|---|---|---|---|---|
| 473,128 | A | | 4/1892 | Rankin |
| D27,021 | S | | 5/1897 | Smith |
| 766,185 | A | | 8/1904 | Harold |
| 877,076 | A | | 1/1908 | Hageman |
| 2,240,689 | A | | 5/1941 | Denton |
| 2,538,980 | A | | 1/1951 | Payne |
| 2,669,434 | A | | 2/1954 | White |
| 2,776,757 | A | | 1/1957 | Schoenlaub |
| 2,950,015 | A | | 8/1960 | Pataky |
| 3,111,303 | A | | 11/1963 | Olson |
| 3,201,160 | A | | 8/1965 | Lewin |
| 3,205,351 | A | | 9/1965 | Walker |
| 3,222,509 | A | | 12/1965 | Thedford |
| 3,285,576 | A | | 11/1966 | Clark |
| 3,350,819 | A | | 11/1967 | Polidor |
| 3,352,541 | A | | 11/1967 | Thom |
| 3,486,739 | A | | 12/1969 | Nelson et al. |
| 3,703,884 | A | | 11/1972 | Maddalena et al. |
| 3,719,386 | A | | 3/1973 | Puckett et al. |
| 3,832,804 | A | * | 9/1974 | Goldsmith ..... 49/13 |
| 3,844,087 | A | | 10/1974 | Schultz et al. |
| 3,940,896 | A | | 3/1976 | Steel |
| 4,037,788 | A | | 7/1977 | Riley |
| 4,114,330 | A | | 9/1978 | Sukolics |
| 4,118,044 | A | | 10/1978 | Celms |
| 4,169,623 | A | | 10/1979 | Smith |
| 4,357,982 | A | | 11/1982 | Yamada et al. |
| 4,371,148 | A | | 2/1983 | Harden |
| 4,380,327 | A | | 4/1983 | Fish |
| 4,520,898 | A | | 6/1985 | Allemane |
| 4,546,855 | A | | 10/1985 | Lyons |
| 4,576,364 | A | | 3/1986 | O'Fearna |
| 4,589,239 | A | | 5/1986 | Cummings |
| 4,652,862 | A | | 3/1987 | Verslycken |
| 4,682,454 | A | | 7/1987 | Simpson et al. |
| 4,682,762 | A | | 7/1987 | Lekavich |
| 4,703,596 | A | | 11/1987 | Sandow |
| 4,750,302 | A | | 6/1988 | Bechtold |
| 4,763,937 | A | | 8/1988 | Sittnick, Jr. et al. |
| 4,796,404 | A | | 1/1989 | Butler |
| 4,833,838 | A | | 5/1989 | Van Dame |
| 4,854,076 | A | | 8/1989 | Sieben et al. |
| 4,933,615 | A | | 6/1990 | Furuya et al. |
| 4,993,757 | A | | 2/1991 | Corzine |
| RE33,720 | E | | 10/1991 | Cummings |
| 5,102,103 | A | | 4/1992 | Putnam |
| 5,152,508 | A | | 10/1992 | Fish |
| 5,291,705 | A | | 3/1994 | Dickerson |
| 5,313,748 | A | | 5/1994 | Hughes, Jr. |
| D354,817 | S | | 1/1995 | Kovacs et al. |
| 5,394,664 | A | | 3/1995 | Nowell |
| 5,496,016 | A | | 3/1996 | Parisien |
| 5,502,934 | A | | 4/1996 | Coyne et al. |
| 5,509,250 | A | | 4/1996 | Jensen et al. |
| 5,524,401 | A | | 6/1996 | Ishikawa et al. |
| 5,553,833 | A | | 9/1996 | Bohen |
| 5,664,769 | A | | 9/1997 | Sadinsky et al. |
| 5,683,074 | A | | 11/1997 | Purvis et al. |
| 5,715,634 | A | | 2/1998 | Schultz |
| 5,802,783 | A | | 9/1998 | Bayha |
| 5,806,255 | A | | 9/1998 | Verby et al. |
| 5,842,685 | A | | 12/1998 | Purvis et al. |
| 5,862,645 | A | | 1/1999 | Lee |
| D410,289 | S | | 5/1999 | Howard et al. |
| 5,941,024 | A | | 8/1999 | Journault |
| 5,983,593 | A | | 11/1999 | Carbary et al. |
| 6,061,993 | A | | 5/2000 | Bendixen et al. |
| 6,095,283 | A | | 8/2000 | Ellis |
| 6,138,433 | A | | 10/2000 | Ridge |
| 6,167,659 | B1 | | 1/2001 | Swindell, III |
| 6,199,330 | B1 | | 3/2001 | Cobb |
| 6,253,530 | B1 | | 7/2001 | Price et al. |
| 6,260,323 | B1 | | 7/2001 | Hockey |
| 6,263,624 | B1 | | 7/2001 | Hoy et al. |
| 6,272,800 | B1 | | 8/2001 | Phinney et al. |
| 6,293,051 | B1 | | 9/2001 | Matye |
| 6,308,486 | B1 | | 10/2001 | Medland et al. |
| 6,347,685 | B1 | | 2/2002 | Ellis |
| 6,354,046 | B1 | | 3/2002 | Swearingen |
| 6,375,164 | B1 | | 4/2002 | Siegler et al. |
| 6,467,118 | B2 | | 10/2002 | Dumlao et al. |
| 6,467,230 | B1 | | 10/2002 | Perkins et al. |
| 6,477,972 | B2 | | 11/2002 | Perkins |
| 6,513,197 | B2 | | 2/2003 | Rude et al. |
| 6,542,077 | B2 | * | 4/2003 | Joao ..... 340/426.16 |
| 6,561,373 | B1 | | 5/2003 | Chapin |
| 6,572,182 | B2 | | 6/2003 | Lamparter et al. |
| 6,604,329 | B2 | | 8/2003 | Hoy et al. |
| 6,604,332 | B1 | | 8/2003 | Hughes et al. |
| 6,607,053 | B1 | | 8/2003 | Warren |
| 6,619,428 | B2 | | 9/2003 | Ellis |
| 6,681,528 | B1 | | 1/2004 | Profeta et al. |
| 6,688,046 | B2 | | 2/2004 | Perkins |
| 6,699,558 | B1 | | 3/2004 | Milburn |
| 6,739,104 | B2 | | 5/2004 | Tokonabe et al. |
| 6,739,583 | B2 | | 5/2004 | Ryon |
| 6,857,622 | B2 | | 2/2005 | Okita |
| 6,892,751 | B2 | | 5/2005 | Sanders |
| 6,931,793 | B2 | | 8/2005 | Joyce et al. |
| 6,952,996 | B2 | | 10/2005 | Sisk et al. |
| 7,000,557 | B1 | | 2/2006 | Forbes et al. |
| 7,055,440 | B2 | | 6/2006 | Sisk |
| 7,082,726 | B2 | | 8/2006 | Prenn et al. |
| 7,134,254 | B1 | | 11/2006 | Van Gelder |
| 7,300,037 | B2 | | 11/2007 | Beirne, Jr. et al. |
| 7,338,033 | B2 | | 3/2008 | Anson et al. |
| 7,513,014 | B2 | | 4/2009 | Lin |
| 7,516,575 | B2 | | 4/2009 | Cuccurullo |
| 7,638,962 | B2 | | 12/2009 | Cardwell |
| 8,522,487 | B2 | | 9/2013 | Whiting et al. |
| 2004/0104382 | A1 | | 6/2004 | Collins et al. |
| 2004/0262314 | A1 | | 12/2004 | Weatherhead et al. |
| 2005/0115173 | A1 | | 6/2005 | Joyce et al. |
| 2005/0166458 | A1 | | 8/2005 | McKenzie et al. |
| 2006/0102886 | A1 | | 5/2006 | Rosenbaum |
| 2006/0202815 | A1 | | 9/2006 | John |
| 2007/0241709 | A1 | | 10/2007 | Cardwell |
| 2008/0060874 | A1 | | 3/2008 | Lair |
| 2010/0031573 | A1 | | 2/2010 | Whiting et al. |
| 2011/0017967 | A1 | | 1/2011 | Whiting |

(56) References Cited

U.S. PATENT DOCUMENTS

FOREIGN PATENT DOCUMENTS

| | | | |
|---|---|---|---|
| WO | WO-9733062 | A1 | 9/1997 |
| WO | WO-2006083953 | A2 | 8/2006 |
| WO | WO-2010017399 | A2 | 2/2010 |
| WO | WO-2010151892 | A1 | 12/2010 |

OTHER PUBLICATIONS

Roof Accessories product brochure by Activar Inc., copyright 2007 (4 pages).

U.S. Appl. No. 14/257,280, filed Apr. 21, 2014; first-named inventor: Richard J. Whiting.

BlueWater Manufacturing, Grab-Bar Roof Hatch Fall Protection product advertisement, www.bluewater-mfg.com/grab-bar.htm; copyright 2005 (1 page).

PS Doors Safety Product Group, Hatchsafe Roof Hatch Railing System, copyright 2009 (2 pages).

PS Doors Safety Product Group, Hatchgrip, www.psdoors.com; copyright 2009 (1 page).

Roofing Contractor Magazine, Jun. 2009, p. 10 "Bil-Guard Hatch Rail System" and the Classifieds page "The Safety Rail Source" (3 pages).

Photo taken at Safety 2009—ASSE tradeshow in San Antonio, Texas, on Jun. 29, 2009; product by LadderTech, LLC; www.ladderport.com (1 page).

LadderPort Jan. 2009 catalog, "Your Roof Access & Ladder Safety Source," (12 pages).

Garlock Safety Systems, Railguard 200 advertisement, www.railguard.net/roof-hatch-safety.asp; copyright 2009 (2 pages).

U.S. Appl. No. 61/318,284 entitled "Automatic Retractable Hatch Guard;" Inventor Michael Cardwell, filed Mar. 27, 2010.

Engineered Fall Protection and Confined Space Systems, "Roof Hatch Fall Protection," Datasheet [online]. WS Safety Technologies, 2008. Internet address: http://www.wssafety.com/roof-hatch-fall-protection.html, (1 page).

International Search Report and Written Opinion in PCT Patent Application No. PCT/US09/040250, dated Sep. 17, 2010 (10 pages).

"Stairways and Ladders" A Guide to OSHA Rules, U.S. Department of Labor, OSHA 3124-12R, 2003 (15 pages).

"Open Roof Hatches Should Be Protected; Grab Bars Not Required at Hatch Exits," OSHA Standard Interpretations, Standard No. 1910.27(c)(7); 1910.23; Jul. 12, 2000 (2 pages).

U.S. Appl. No. 61/269,593, filed Jun. 26, 2009; first-named inventor: Richard J. Whiting.

* cited by examiner

SAFETY HATCH SYSTEM

CROSS REFERENCE TO RELATED APPLICATIONS

This application is a continuation of U.S. patent application Ser. No. 12/537,112, filed Aug. 6, 2009, entitled "Safety Hatch System and Egress" now U.S. Pat. No. 8,522,487, issued Sept. 3, 2013 which claims the benefit of U.S. Provisional Patent Application No. 61/188,086, filed Aug. 6, 2008 entitled "Safety Hatch System and Egress Method."

TECHNICAL FIELD

This invention relates to electronically controlled hatch systems and methods to provide safer, more secure, and less hazardous ingress and egress through access ports, which are positioned on roofs, floors, or other similar structures, thereby reducing injury to personnel and damage to property.

BACKGROUND

Flat roofed buildings, roadways, catwalks, attics, skylights, and other similar structures, commonly include access ports, such as a roof portal, manhole, or other similar structure, with or without a hatch or lid, for ingress and egress to a roof, roadway, catwalk, elevated deck, etc. Many times, these access ports are located in elevated positions away from walls or other supporting structures, thereby, necessitating the user to make steep climbs over high elevations for ingress and egress. With high elevations and steep climbs the risk of harm to a user from a fall is already great; however, when factoring in a user's fear of heights, vertigo, or other emotional and/or physiological responses, the risk of harm to the user from falling through an access port greatly increases. Moreover, additional factors, such as transporting equipment through access ports, may further increase the risk of harm to the user.

While it is of the most importance for personnel to egress and ingress through an access port in a safe manner it is also important for building owners and proprietors to reduce loss and liability. The act of climbing to or from an elevated height to manually operate and pass through an access port, such as a roof scuttle hatch, floor opening, elevated deck or skylight, is a very dangerous undertaking. Numerous hazards can cause an employee to trip, slip, or fall. In fact, records with U.S. Department of Labor Occupational Safety & Health Administration (OSHA) statistically show that occupational accidents often result in death. Occupational fatalities caused by falls remain a serious public health problem throughout the United State.

A significant safety issue facing personnel having a need to ingress or egress through an access port, which usually requires a climb to or from an unsafe height above a floor or deck, the location of which is most often in a darkened and out of the way location within a building, is low or dim lighting. The low light results in impaired vision or temporary blinding upon sudden exposure to bright light making if difficult to locate and secure solid footing or hand grab holds while ascending or descending.

Additionally, personnel ascending or descending a ladder to egress or ingress through an access port often must hang precariously onto a rail of the ladder with one hand while using the other hand to reach back, usually at an awkward and dangerous angle, to unlock or lock and open or close the hatch covering the access port. This precarious procedure for unlocking or locking and opening or closing the hatch is further complicated with danger and safety concerns by the fact that many hatches are bulky and heavy, may have worn out spring assisted hinges, and can swing open and close violently under their own weight or in conjunction with high winds.

Moreover, personnel ingressing or egressing through an access port may have to precariously perch on the top rung of a ladder with the only hand hold or grab hold being the top of a scuttle hatch curb, which is often one foot or more above the top rung of the ladder, in order to exit or enter the hatch, which is a difficult and dangerous balancing act, especially at dangerously high elevations.

Furthermore, additional safety concerns and dangers associated with access portals include security concerns, which typically occur from break-ins and vandals, safety of people and property located under a roof or other surface with an access portal, and weather concerns, including heavy rains, extreme temperatures, high water dangers on flat roofs, freezing ice or snow, high winds, and lightning, which can affect the safety and work environment of personnel ingressing or egressing through an access portal.

SUMMARY

In light of the dangerous safety and security problems associated with access ports, such as a roof scuttle hatches, floor openings, or skylights, the present invention presents the unique opportunity to dramatically reduce accidents and loss associated with ingress and egress through access ports.

It is an embodiment of the present invention to provide an electronically controlled hatch system for use with an access port for ingress or egress, said hatch system comprising: a hatch cooperable with said access port for limiting entry and exit through said access port, wherein said hatch has at least an open position and a closed position; an actuator cooperable with said hatch and capable of raising and lowering said hatch to at least the open position and the closed position; at least one safety rail mounted adjacent to said access port; and a central control unit operable to communicate with the actuator to position the hatch.

It is an embodiment of the present invention to provide an electronically controlled hatch system for use with an access port for ingress or egress, said hatch system comprising: a hatch cooperable with said access port for limiting entry and exit through said access port, wherein said hatch has at least an open position and a closed position; at least one guide rail mounted adjacent said hatch; at least one safety rail retractably mounted adjacent said access port and cooperable with said guide rail to raise and lower said hatch to the open position and the closed position as said safety rail is retractably raised and lowered; an actuator cooperable with said safety rail for raising and lowering said safety rail; and a central control unit operable to communicate with the actuator to position the hatch.

It is an embodiment of the present invention to provide a latch system for locking and unlocking a lock mechanism, the latch system comprising: a clevis bracket, having a bracket opening therethrough; a pivot plate, having a pivot opening therethrough, positioned adjacent the clevis bracket; a pivot pin passing through the clevis bracket opening and the pivot opening operable to allow the pivot plate to movably pivot thereupon; an actuator, having an actuator arm, wherein the actuator arm interfaces with said pivot plate; and a pivot rod, having a first location and a second location, wherein the pivot rod interfaces with the pivot plate adjacent the first location and interfaces with the lock mechanism adjacent the second location; wherein movement of the actuator arm in a first direction causes responsive movement of the pivot plate, which causes the pivot rod to move in a second direction, thereby locking or unlocking said lock mechanism.

It is an embodiment of the present invention to provide a method for use of an electronically controlled hatch system, the method comprising: detecting hazard, security, or safety information from a sensor; transmitting the information to a central control unit; processing the information at the central control unit and generating output information by the central control unit; and transmitting at least a portion of the output information to the actuator for operating the hatch system.

It is an embodiment of the present invention to provide a method for use of an electronically controlled hatch system, the method comprising: detecting hazard, security, or safety information from a sensor; transmitting the information to a central control unit; processing the information at the central control unit and generating output information by the central control unit; transmitting at least a portion of the output information to an output device for communicating to a user; and transmitting at least a portion of user information to the central control unit for operating the hatch system.

It is an embodiment of the present electronically controlled hatch system to provide an effective and reliable system and method of safe egress to and from elevated areas.

It is an embodiment of the present electronically controlled hatch system to provide detection of dangerous conditions prior to or during egress and provide a secure safe area to perform repairs or maintenance along with added safety and security of the building, occupants, and contents and to forewarn the proper personnel of dangerous conditions, safeguarding all within or on a structure.

It is an embodiment of the present electronically controlled hatch system to provide a safer entry into a secured area through a well lighted automated moveable entryway (e.g., hatch, door, or any other moveable barrier).

It is an embodiment of the present electronically controlled hatch system to provide real-time dangerous weather information. For example, dangerous conditions in or around the secure entryway/access port may cause the system to emit a warning alert in the form of lights, visible message readouts, audible alarms, and/or voice messages. The safety protection system may also provide alerts regardless of whether or not the personnel are aware of a danger.

It is an embodiment of the electronically controlled hatch system that personnel may ascend or descend through the access port, via an access ladder or other climbing means, using both hands at all times securely on the ladder without taking hands off the ladder rails or rungs to unlock/lock or push open and manipulate the hatch cover lid, nor have the worry of the hatch accidentally and unexpectedly coming closed resulting in an injury or fall.

It is an embodiment of the electronically controlled hatch system that upon full decent of all personnel to the safety of the ground level personnel may then retract the safety rails, close the hatch, and activate any security features by operating the keypad or a remote unit.

Embodiments of the electronically controlled hatch system described herein may reduce the risk of falls while ascending or descending a ladder through an access port in least in part by automatically detecting weather hazards, security, and other safety information, transmitting the information to a centralized controller for processing, and regulating the opening and closing of the hatch, which covers the access port, and/or the raising and lowering the safety railing system based on said information and/or user input.

The foregoing embodiments are intended only to describe and provide insight into various aspects and combinations of the invention and should not be construed or used for any other purpose, or to limit the invention in any manner.

DETAILED DESCRIPTION

Figure 1:
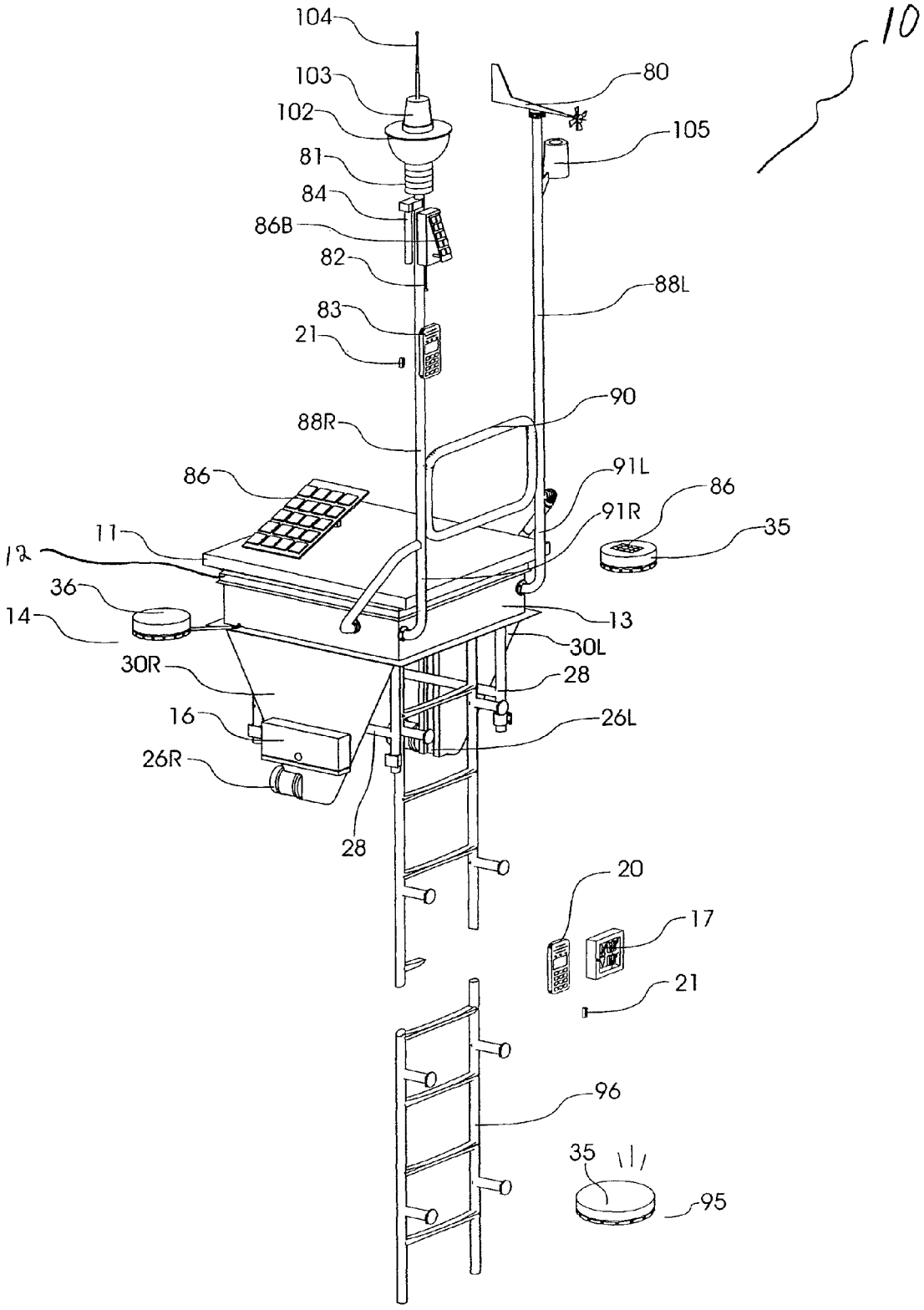
FIG. 1 is a perspective view that illustrates an embodiment of an electronically controlled hatch system with the access port hatch in a closed position, the protractile/retractable safety rail in a retracted position, and a plurality of hazard, security, and safety detection devices.

It should be understood at the outset that although an exemplary implementation of the present invention is illustrated below, the present invention may be implemented using any number of techniques, materials, designs, and configurations whether currently known or in existence. The present invention should in no way be limited to the exemplary implementations, drawings, and techniques illustrated below, including the exemplary designs and implementations illustrated and described herein.

In the description which follows, like parts are marked throughout the specification and drawings with the same reference numerals, respectively. The drawings are not necessarily to scale and certain features may be shown exaggerated in scale or in somewhat schematic form in the interest of clarity and conciseness.

Referring initially to FIGS. 1, 2, 5, and 8, an embodiment of the electronically controlled hatch system 10 is provided and may include, in one form, a protractile/retractable safety rail 28 which automatically extends as the hatch 11 rises to its open position over the access port 12. The safety rail 28 provides a safety barrier around the access port 12 while the hatch 11 is in the open position, thus providing a fulltime safety rail system around the opening of the access port 12, which protects the safety of personnel from accidental fall through while the hatch 11 is in the open position. By retracting the safety rail 28 inside away from the damaging effects of the exterior elements, it also provides an aesthetically cleaner look of design for the building or other structure having the access port 12.

Referring again to FIGS. 1, 2, 5, and 8, an embodiment of the electronically controlled hatch system 10 is provided and includes, in one form, a hatch 11 cooperable with said access port 12 for limiting entry and exit through said access port 12, wherein said hatch 11 has at least an open position (such as the position shown in FIG. 3) and a closed position; at least one guide rail 98 mounted to said hatch 11; at least one safety rail 28 retractably mounted within said access port 12 and cooperable with said guide rail 98 to raise and lower said hatch 11 to its open position and its closed position as said safety rail 28 is retractably raised and lowered; an actuator 26R cooperable with said safety rail 28 for raising and lowering said safety rail 28; and a central control unit 16 for operating the hatch system 10.

Figure 3:
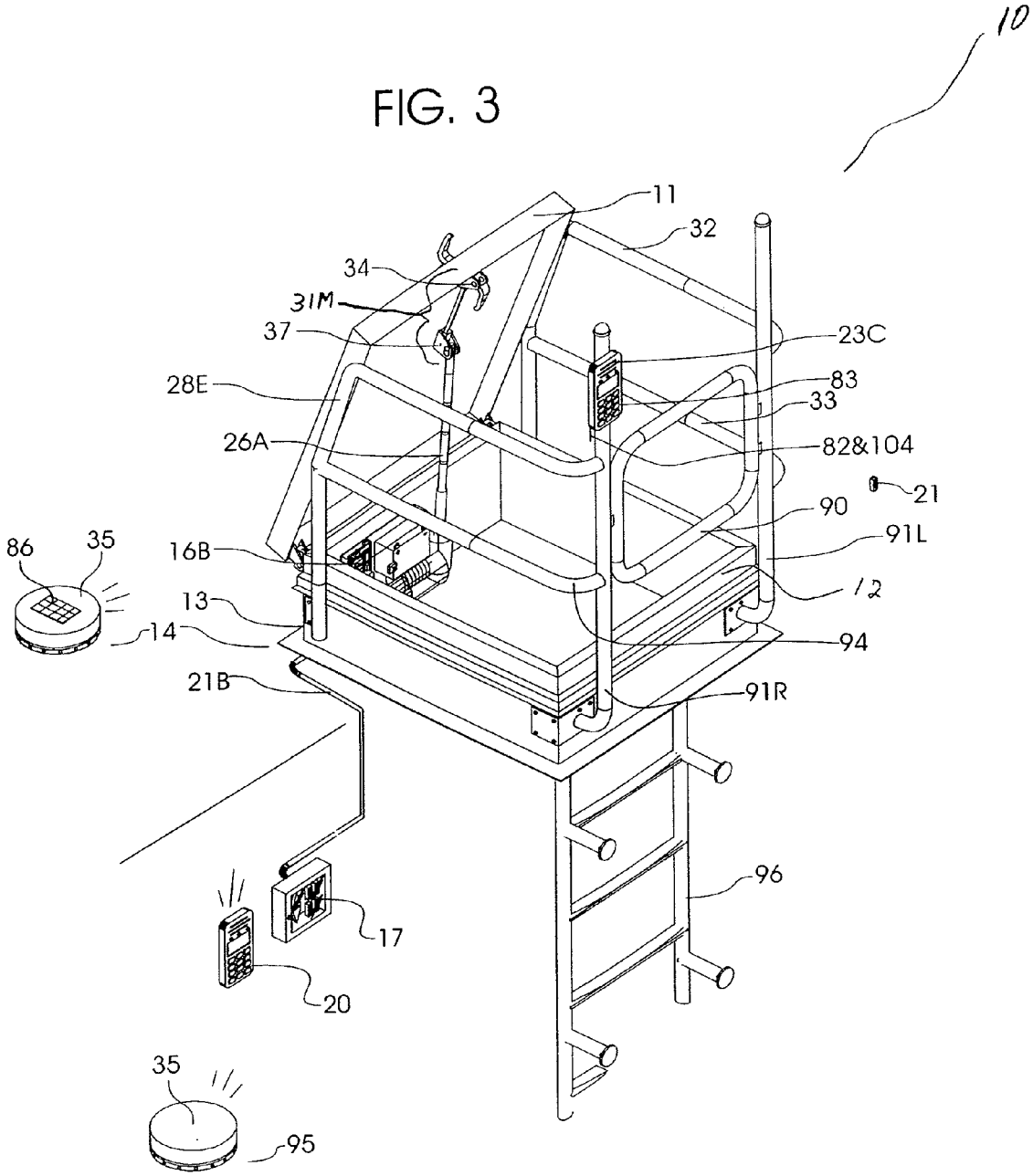
FIG. 3 is a perspective view that illustrates an embodiment of an electronically controlled hatch system with the access port hatch in the open position and an external non-protractile/non-retractable safety rail system.
Figure 4:
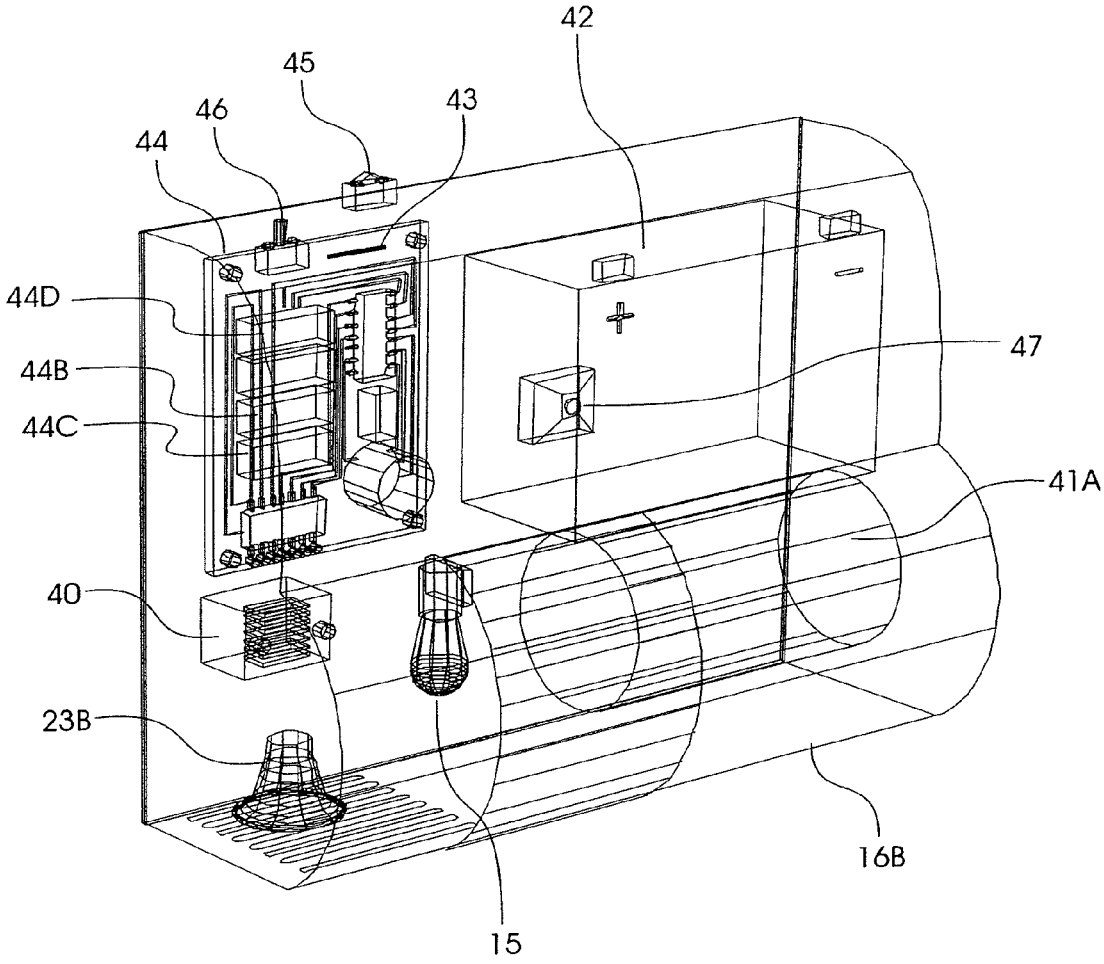
FIG. 4 is a transparent, perspective view that illustrates an embodiment of a central control unit.
Figure 7:
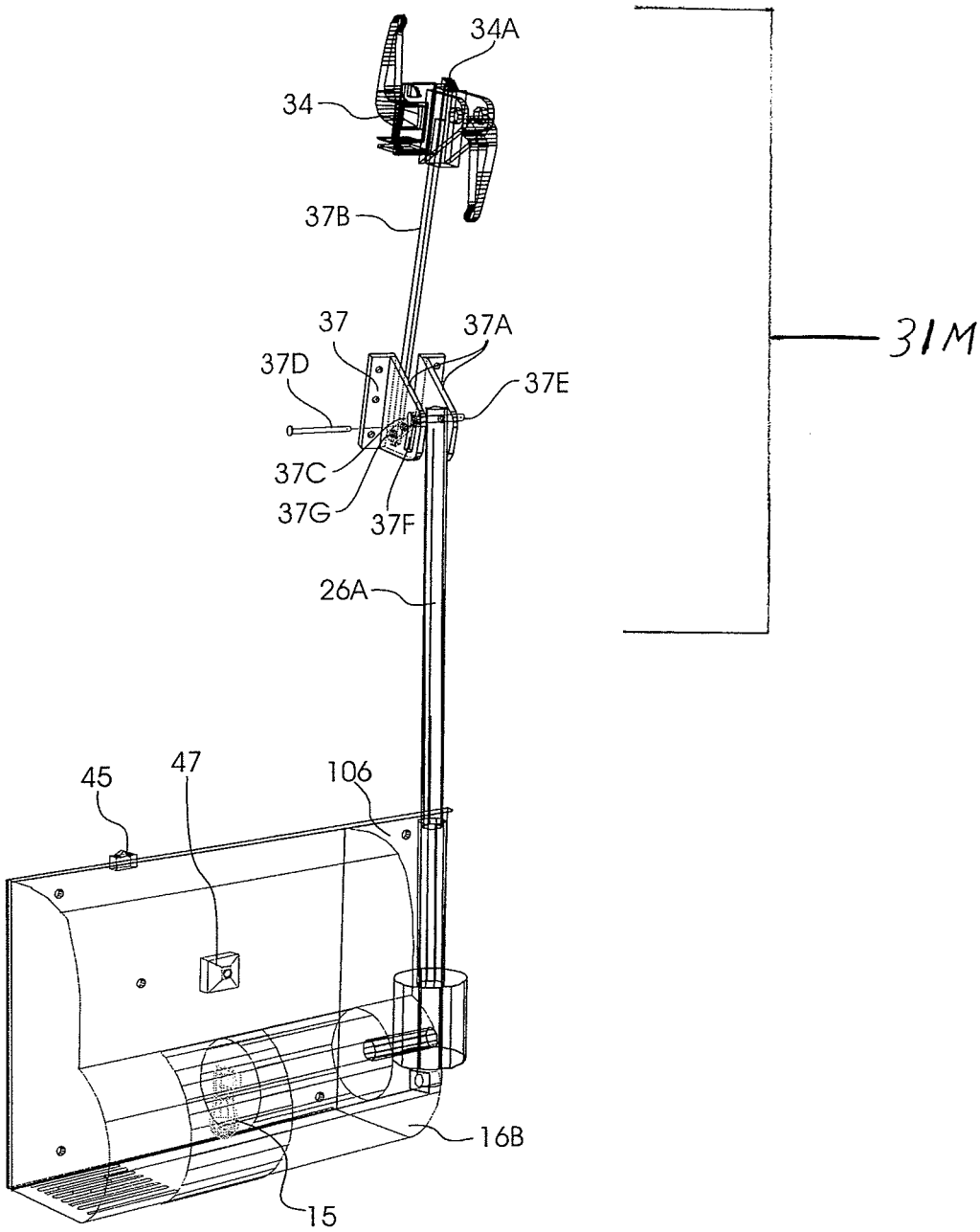
FIG. 7 is a perspective view that illustrates an embodiment of a mechanical lock apparatus with a linear actuator.

Referring to FIGS. 3 and 7, an embodiment of the electronically controlled hatch system 10 is provided and includes, in one form, a hatch 11 cooperable with said access port 12 for limiting entry and exit through said access port 12, wherein said hatch 11 has at least an open position and a closed position; an actuator 26A cooperable with said hatch 11 and capable of raising and lowering said hatch 11 to at least its open position and closed position; at least one safety rail 28E mounted adjacent to said access port 12; and a central control unit 16B for operating the hatch system 10.

Referring generally to FIGS. 1, 2, 3, and 8, in yet another embodiment, the safety rail 28 may provide a horizontal, vertical, and/or angled grab holds (32, 33, 91, 94), forward and above the leading edge of the curb of the access port 12, for aiding in ingress or egress through the access port 12 and the hatch system 10. The grab holds (32, 33, 91, 94) may be angled and/or knurled for ergonomic interface with a user's hands and/or feet when ascending or descending through the access port 12 and hatch system 10. The safety rail 28 may also include a horizontal upper safety side rail 32 and a horizontal lower safety side rail 33, which provide additional grab holds for ascending and descending through the access port 12 and further provide safety from personnel falls through the access port 12. In addition to a greater opportunity of hand and foot holds for ingress and egress, the additional hand and foot holds act as emergency grab holds if one would happen to slip or lose balance during ingress or egress. The safety rail 28 and/or the grab holds (32, 33, 91, 94) may also serve as a convenient and secure mounting surface for safety, hazard detection, and other chosen equipment.

Still referring generally to FIGS. 1, 2, 3, and 8, the hatch system 10 may include a gate for limiting access to the access port 12. In some embodiments, the gate 90 may be directly mounted to the floor 95 or deck 14 of the structure housing the access port 12 by use of one or more structures having at least a generally vertical portion or other suitable surface for mounting. In some embodiments, the gate 90 may have an open position that allows for a user to ingress or egress freely through the area covered by the gate 90. In yet other embodiments, the gate 90 may have a closed position that prevents a user from intentionally ingressing, egressing, or unintentionally falling through the area covered by the gate 90. In yet other embodiments, the gate 90 may be biased, via spring, piston, electronic actuator, or otherwise, to automatically return to its closed position after being opened, but prohibited from closing inwardly over the access port 12. In yet other embodiments, the gate 90 may operate to automatically return to its closed position via gravity by angling the vertical orientation of the gate's 90 swing axis or axis of rotation in a manner that it is offset from vertical to cause the gate 90 to automatically return to its closed position. In yet other embodiments, the gate 90 may operate to automatically return to its closed position via combination of a biasing member and gravity. In yet other embodiments, more than one gate 90 may be used to limit access to the access port 12.

Referring again to FIG. 1, in yet another embodiment, the grab post 91L may act as a vertical support for a gate 90 and an opposing side support grab post 91R would act at a stop for the gate 90.

Referring again to FIG. 1, in yet another embodiment, the grab post 91L and 91R are made tall enough not to pose a safety hazard in the event personnel would fall near the hatch 11.

Figure 2:
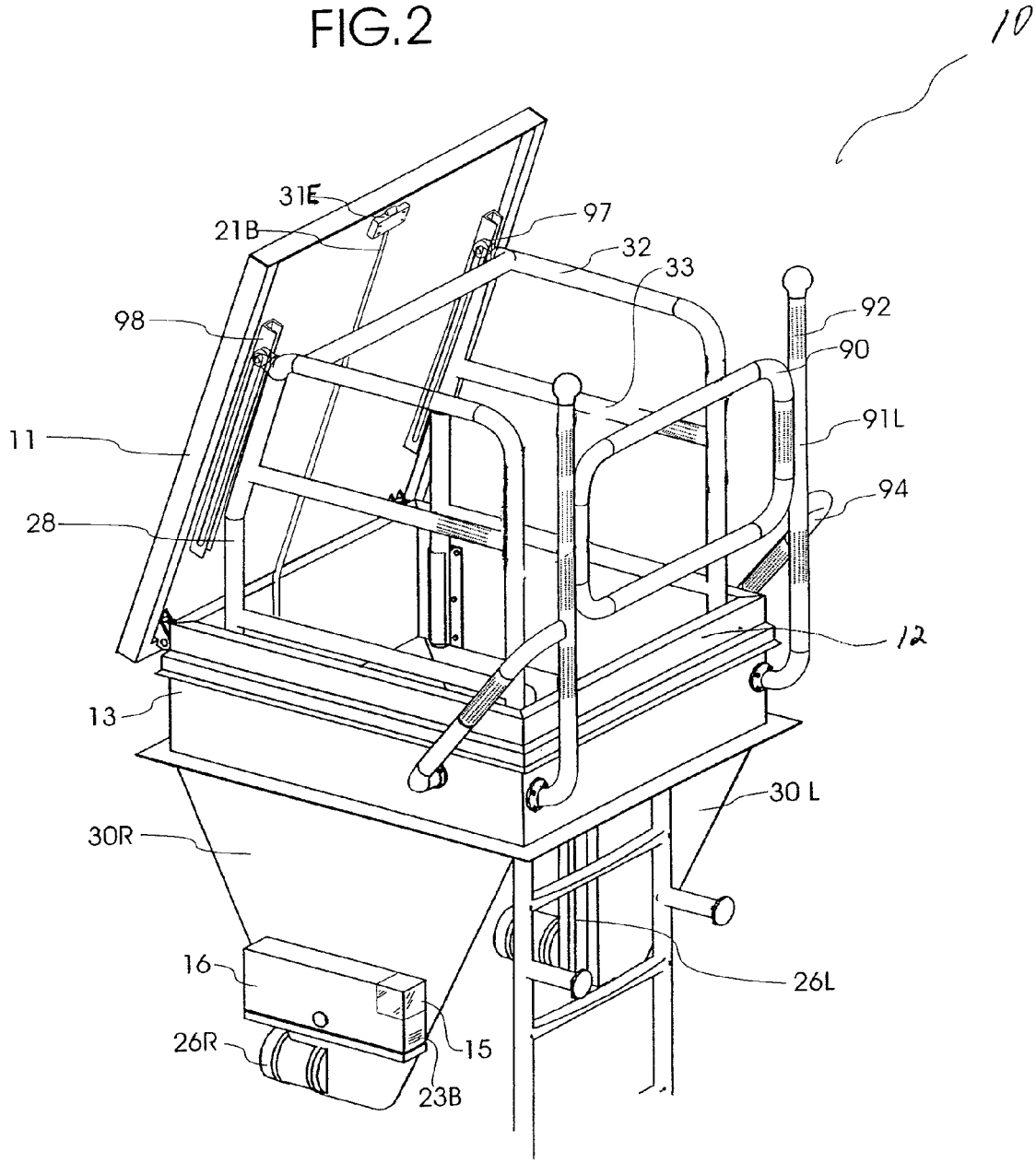
FIG. 2 is a perspective view that illustrates an embodiment of an electronically controlled hatch system with the access port hatch and the protractile/retractable safety rail in the open and extended safety position.

Referring generally to FIGS. 1, 3, 5, 7, and 8, in yet another embodiment, the hatch 11 is raised or lowered using an actuating system positioned below the floor 95 or the deck 14. The action for the hatch 11 may be provided by a screw linear actuator 26A or multiple actuators 26R and 26L, as shown in FIGS. 1, 2 and 3. Alternatively, action may be provided by jackscrew, scissor mechanism, hydraulic actuator gear and/or motor or other mechanical or lifting devices.

Figure 8:
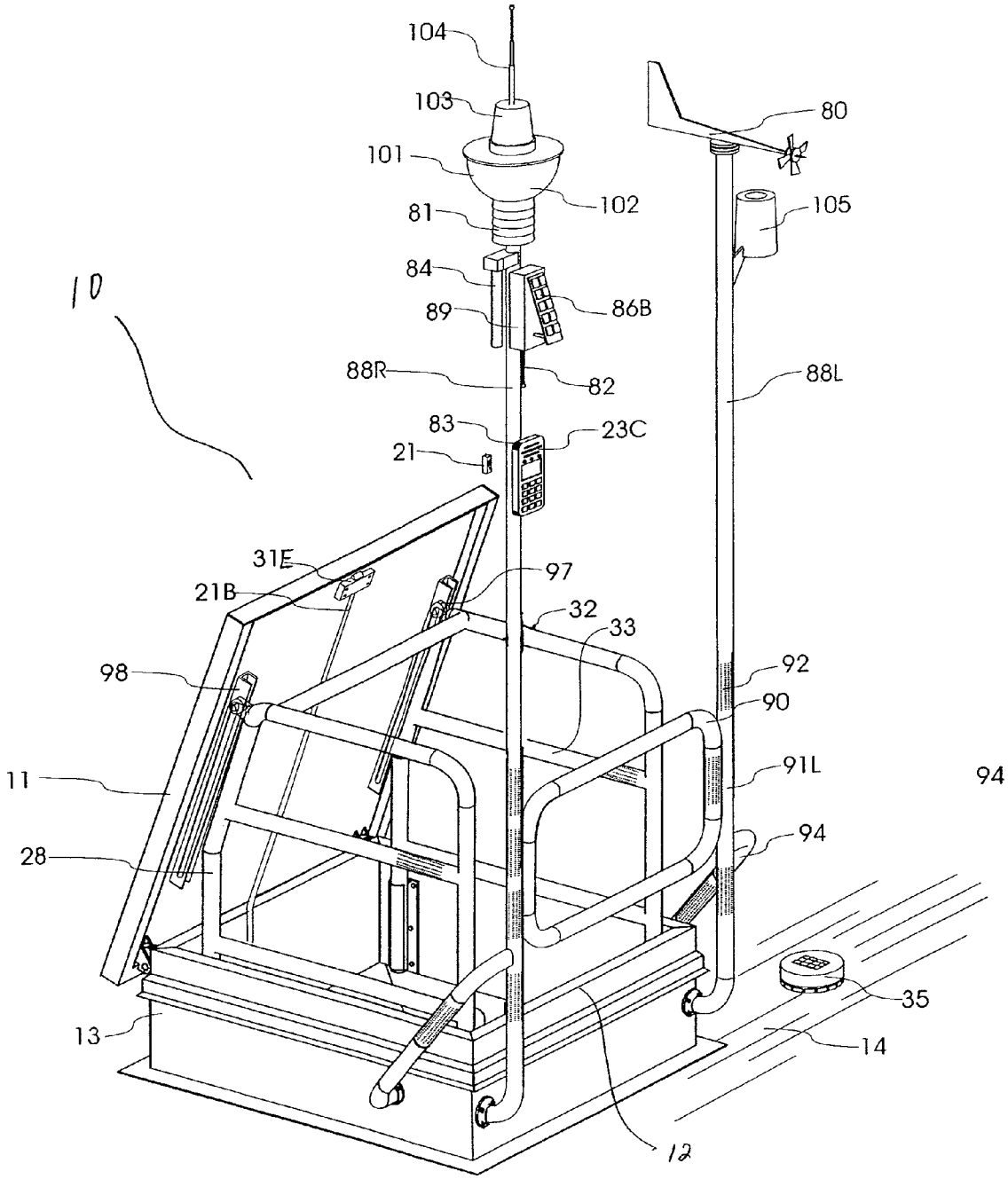
FIG. 8 is a perspective view that illustrates an embodiment of an electronically controlled hatch system with a protractile/retractable safety rail system and a plurality of hazard detection, security, and safety devices.

Referring to FIGS. 2 and 8, in yet another embodiment, the hatch 11, or scuttle curb 13, and or protractile/retractable safety rail 28 has an electrical lock apparatus 31E to lock, unlock, bolt, latch and/or unlatch utilizing electrical power, from the actuating system or otherwise, and thus allowing for the locking and unlocking of said hatch 11 from the safety of the floor 95 or deck 14 without having to ascend or descend a ladder 96 (shown in FIG. 3). In an alternative embodiment, as illustrated in FIGS. 3 and 7, the hatch 11 has a mechanical lock apparatus 31M with a lock portion 34 and a latch portion 37 to latch and unlatch using the movement of the linear actuator 26A to actuate the latch portion 37, which is connected or coupled, either directly or indirectly, to a pivot rod 37B, which is connected or coupled, either directly or indirectly, to the lock portion 34, and unlock said hatch 11 from the safety of the floor 95 or deck 14 without having to ascend or descend the ladder 96.

Figure 7A:
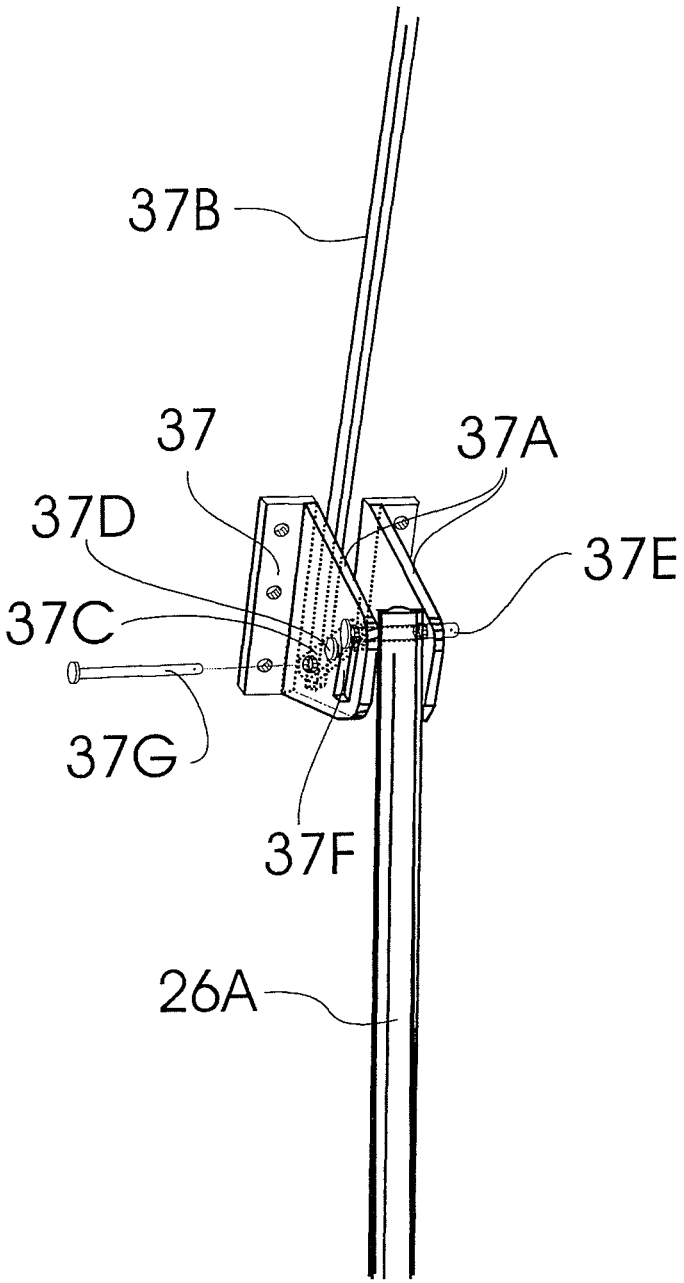
FIG. 7A is a perspective view that illustrates an embodiment of a latch portion of a mechanical lock apparatus.
Figure 7B:
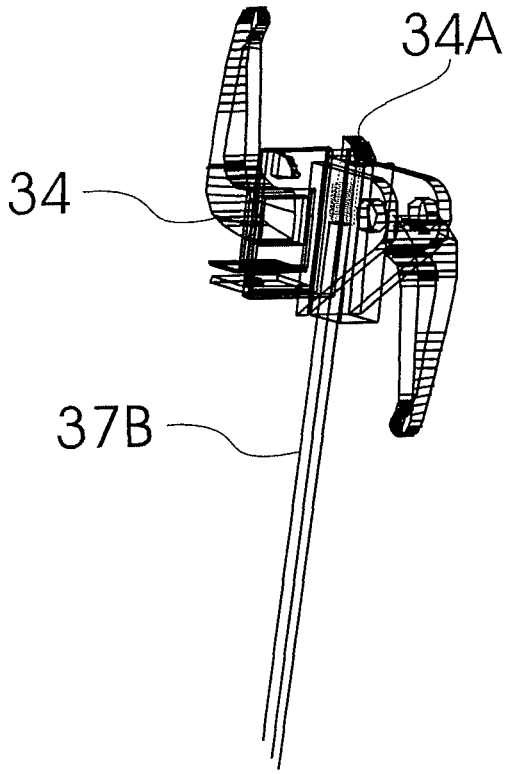
FIG. 7B is a perspective view that illustrates an embodiment of a lock portion of a mechanical lock apparatus.

In one embodiment, as illustrated in FIGS. 7A and 7B, the latch portion 37 may be affixed to the inner surface of the hatch 11 and may latch, unlatch, lock, unlock, and/or secure the hatch 11 to the access port 12 by way of the actuator 26A. Said latch portion 37 may operate the lock portion 34, via pivot rod 37B. The latch portion 37 may consist of a stationary single or double ear clevis bracket 37A with a single or dual moving pivoting plate 37C, which may be a plate, rod, tube, or other suitable structure, affixed to the clevis bracket 37A with a centering axle pivot pin/bolt 37D. This arrangement allows for limited fore and aft movement of the pivot plate 37C when said pivot plate 37C is connected at one end to the actuator arm 26A, via a traversing pivot pin/bolt 37E, which passes through the actuator arm 26A, pivot plate 37C, and elliptical bore 37F of the clevis bracket 37A. Said elliptical bore 37F allows for limited movement of the pivot plate 37C thus blocking or limiting the travel as not to overload the lock portion 34. At the opposite end of the pivot plate 37C, a pivot rod 37B, or other connecting rod, turnbuckle, or the like, may be affixed, via a pivot pin/bolt 37G, in a manner to allow the motion, e.g., extension or retraction, of the actuator arm 26A to push or pull on the pivot plate 37C in a limited manner, which ultimately causes the pivot rod 37B to move or travel in substantially the opposite direction of the actuator arm 26A. Such movement of the pivot rod 37B causes the pivot rod 37B to actuate the locking bolt 34A of the lock portion 34 of the mechanical lock apparatus 31M while simultaneously raising and lowering the hatch 11 in one smooth motion without any additional electrical locking device or without personnel having to operate or manipulate by hand a lock, key, and/or latching assembly while precariously balancing high up a ladder. In yet another embodiment, the latch portion 37 may support the hatch 11 in the open position eliminating the need for personnel to reach behind themselves, while standing high upon a ladder, to raise and secure the hatch 11 in the open position. The mechanical latch apparatus 31M may be implemented using various other mechanical linkages and structural arrangements to achieve the desired unlocking and raising of the hatch 11.

Figure 5:
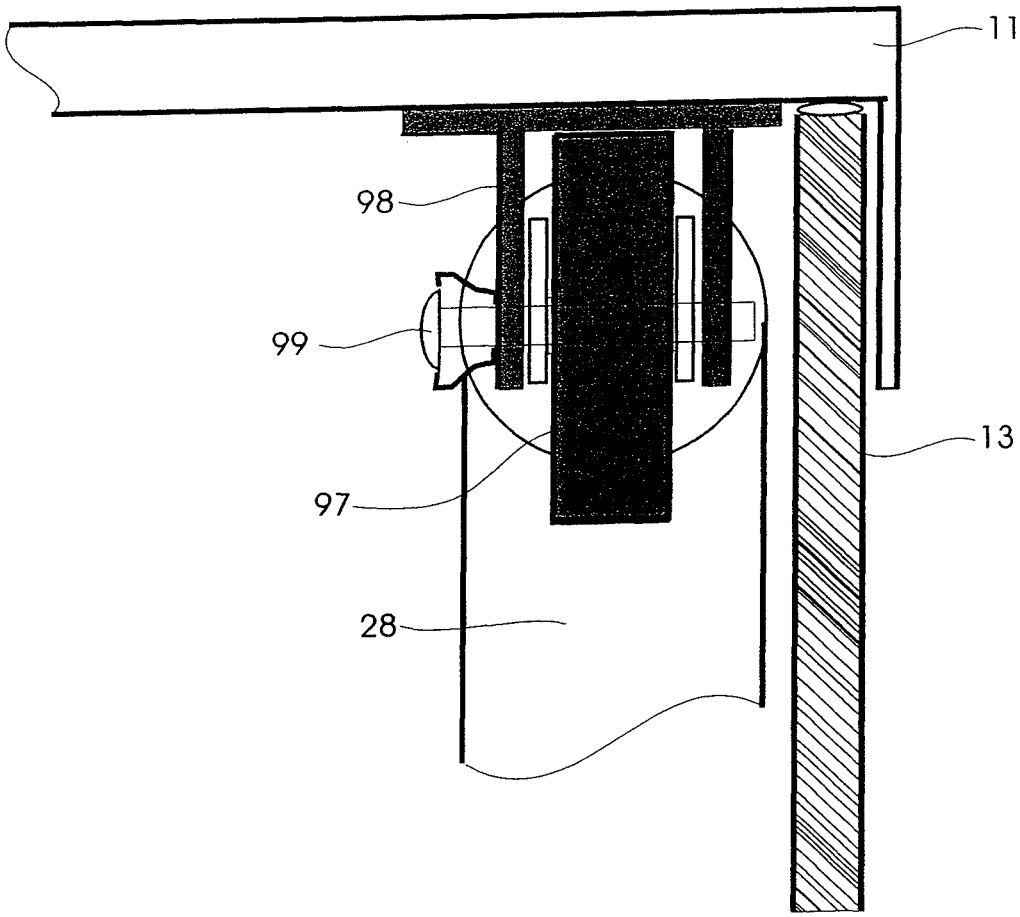
FIG. 5 is a cutaway front view that illustrates an embodiment of an access port hatch guide.

Referring to FIGS. 2, 5, and 8, in yet another embodiment, the ascent and descent of the protractile/retractable safety rail 28 facilitates the opening and closing of the hatch 11 with the aid of a roller 97 and guide rail 98. In one embodiment the protractile/retractable safety rail 28 is deployed and retracted using electronic actuators, for example a first side actuator 26R, a second side actuator 26L, and, as partially shown in FIG. 3, may operate using an actuator 26A that is mounted to interface directly with the hatch 11, which hatch 11 would then interface with the protractile/retractable safety rail 28 for facilitating the opening and closing of the hatch 11.

Referring to FIGS. 1, 2, 5, and 8, in yet another embodiment, the protractile/retractable safety rail 28 is equipped with a guide rail 98 roller 97 to guide and assist ease of hatch 11 lift and reduce wear or chaffing of safety rail 28 and hatch 11. This roller 97 with axle shaft 99 would also act as a locking device when hatch 11 is in the closed position by way of the controlling the power to the linear actuator 26.

Referring to FIGS. 1, 2, 5, and 8, in yet another embodiment, the hatch 11, the electrical lock apparatus 31E or mechanical lock apparatus 31M, and/or protractile/retractable safety rail 28 may be manually unlocked, manually deployed and/or manually retracted, via removal or disconnect of a pull-pin, bolt, screw, or other suitable type of connector or linkage. Such manual activation may be necessary when, for example, there is no electrical power to the electronically controlled hatch system 10, when an emergency (e.g., a fire) requires use of the hatch system 10, or when the user does not have the keys or access authority to operate the hatch system 10.

Referring to FIG. 3, in yet another embodiment, the hatch 11 operates independent of the safety rail 28E. In yet other embodiments, the safety rail 28E is permanently mounted to the exterior of the scuttle curb 13 or to the surface deck 14.

Referring to FIG. 1, in yet another embodiment, a photovoltaic solar cell panel assembly 86 is mounted externally on the roof area preferably on the weather advisory tower 88, as shown in FIG. 8, or hatch lid 11, as shown in FIG. 1, for supplying primary or secondary power or for charging and maintaining battery 42 or other electric power source during power outages. Also, each individual sensor or device, as described herein, such as an egress light 15, a high water detection sensor 36, and exterior keypad control unit 83, within the hatch system 10, may have their own independent photovoltaic solar cell panel 86. The power supplied by a photovoltaic solar cell panel assembly 86 may not be the total power input needed for any one device or battery. In yet another embodiment, the primary power source for the electronically controlled hatch system 10 may be AC current, by a battery, AC/DC transformer/charger, or other alternative energy source, such as a fuel cell. In yet another embodiment the electronically controlled hatch system 10 is independent of all other power systems.

Referring to FIGS. 1, 2, 3, 4, 7, and 8, in yet another embodiment, when the hatch 11 is opened an ingress/egress light 15 is switched on preferably automatically or manually or via proximity sensors 47, wherein said ingress/egress light 15 is positioned to allow for greater visibility while ascending or descending ladders 96 or accessing interior of access port 12 in a darkened environment. The ingress/egress light 15 will also help when descending during the day to allow for the eyes to adjust from the bright outdoors to the darkened indoor ambient light. Another advantage is when the hatch 11 is opened at night the ingress/egress light 15 will act as a visual warning that the hatch 11 is in the open position. In yet another embodiment, the ingress/egress light 15, or other similar light, is powered by a photovoltaic solar panel assembly 86, independently of the electronically controlled hatch system 10.

Referring to FIGS. 1, 2, 3, 4, and 7, in yet another embodiment, a central control unit 16 (or 16B) is provided that contains various electronic processors/logic circuitry for facilitating the integration and operation of the various design features, as described herein, of the electronically controlled hatch system 10. In some embodiments, the central control unit 16 (or 16B) comprises a central processing unit or motherboard of circuitry for electronically communicating and processing information necessary for the operation of the hatch system 10. In yet other embodiments, the central control unit 16 (or 16B) acts at least partially as a housing for multiple independent processing units or motherboards of circuitry that may operate independently of one another for communicating and processing information necessary for the operation of the hatch system 10. In some embodiments, the central control unit includes an obstacle or obstruction detector/sensor 41A that detects an obstruction on the hatch 11, via resistance to the actuator 26 (such as through the detection of a current surge), or otherwise, and rebounds the hatch 11 and or protractile/retractable safety rail systems 28 to its starting position. In yet another embodiment, power is supplied to the central control unit by fixed wiring 93 from an AC or other suitable power supply. In yet other embodiments, the central control unit 16 may have a self-protection function for protecting the inner workings and back-up power supply battery 42. Such protection may occur by an alarm system located in the control board 44 that disallows unwanted or unauthorized access using the likes of an internal pin switch 46 (or microswitch, magnet switch, or any number of suitable contact switch), wherein unauthorized access may be reported by said switch 46 to said control board 44 for processing and sounding an alarm, such as an audible alarm (23A, 23B, 23C), visual alarm, such as various light warnings, silent alarm with automatic dialer, or other suitable alarm. In yet another embodiment, the central control unit 16 includes the function of a power supply controller for controlling the power input/output of any electronic device, as described herein, included in any embodiment of the electronically controlled hatch system 10.

In yet another embodiment, the electronically controlled hatch system 10 is a primary security management system, and in yet another embodiment, the electronically controlled hatch system 10 is a secondary security management system, wherein said security management system may operate when an alarm is activated in response to the access hatch 11 being forced open or tampered with. Such opening or tampering may be detected using standard alarm sensors such as magnetic contact switch 45 or other suitable detection device. Multiple contact switches 45, or other suitable detection devices, may be employed in various locations when large areas of the electronically controlled hatch system 10 are in need of security, or other security needs are particularly crucial.

Figure 6:
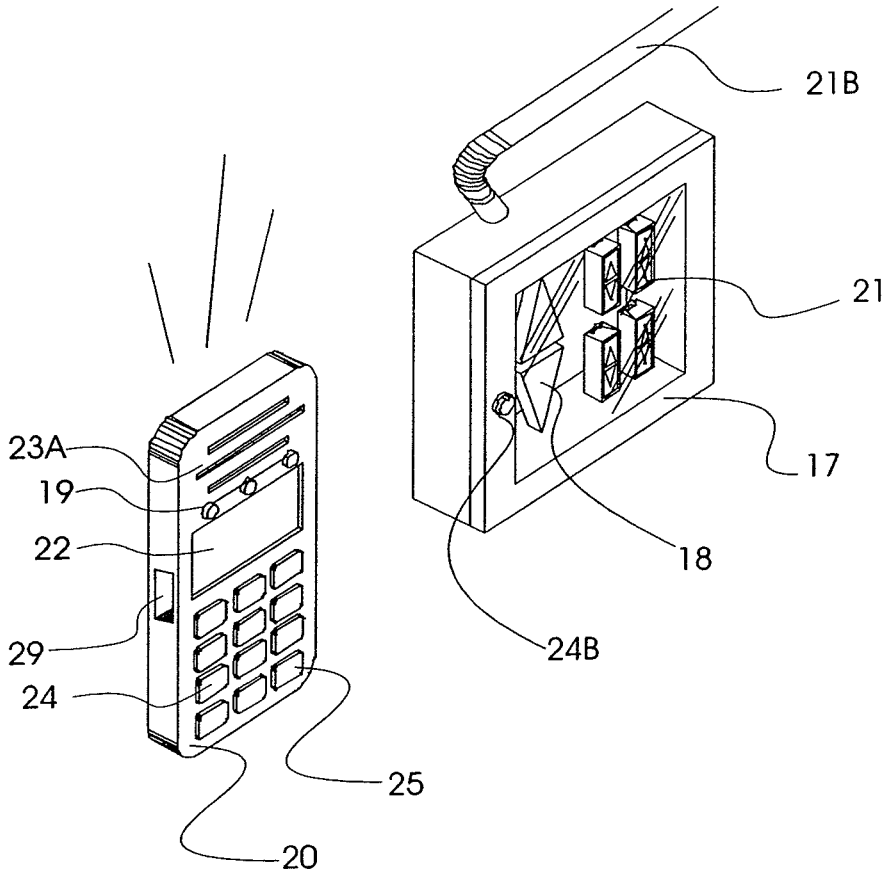
FIG. 6 is a perspective view that illustrates an embodiment of an emergency, break-glass switch box and access keypad control station.

In yet another embodiment, as illustrated in FIG. 6, a keypad control unit 20, which may be mounted on a suitable surface, includes a keypad 24 for control at least one function of the safety protection system, such as opening and closing of the hatch 11.

In yet another embodiment, the central control unit 16 may interface with a building's existing alarm system, telephone system, and/or computer system via an external port 29. However, in other embodiments, the central control unit 16 is independent of all other alarm systems.

Referring again to FIG. 1, in other embodiments, a radio controlled unit/fob 21 controls all or part of the electronically controlled hatch system 10.

Referring again to FIGS. 1, 3, and 8, in yet another embodiment, an exterior keypad control unit 83 may be hard wired for limited or all inclusive control of the electronically controlled hatch system 10, including the hatch 11, protractile/retractable safety rails 28, and or any included security/protection system. In yet another embodiment, the exterior keypad control unit 83 may be wireless. In yet another embodiment, the keypad may be self-powered via a photovoltaic solar assembly 86.

Referring again to FIGS. 4 and 8, in yet another embodiment, an interior proximity sensor 47 and/or exterior proximity sensor 101 may be mounted adjacent to the hatch system 10, for example, mounted adjacent to or within the central control unit, the closed circuit television (CCTV) housing 102, or the mounting rail 88R, for detecting when an intruder, personnel, or both, authorized and unauthorized, approach the hatch 11, be it open or closed, of the access port 12 or area adjacent to the roof 14 in close proximity to the hatch system 10. In such a situation, one of said interior proximity sensor 47 or exterior proximity sensor 101 would provide a signal to central control unit 16 for processing and transmitting to an alarm system, including a warning system or the like, such as a voice warning system, audible alarm (23A, 23B, 23C), visual warning, such as a flashing beacon-strobe light warning 103, and/or silent signal warning to authorities. In other embodiments, said interior proximity sensor 47 and/or exterior proximity sensor 101 may be a passive infrared (PIR) motion detector.

Referring again to FIG. 1, in yet another embodiment, a high water detection sensor 36 is installed on a roof, such as, for example, adjacent to the wall of the scuttle curb 13 or weather advisory tower 88 for early warning of high water levels due to insufficient or plugged water drainage of the roof deck 14 thus providing early warning to help prevent a catastrophic roof or structure failure. In yet another embodiment, the high water detection sensor 36 is wireless and may therefore be located in other potential areas of risk of high water. In yet another embodiment, said sensor 36 may be hard wired. In yet another embodiment, said high water detection sensor 36 may transmit its detection signal to the central control unit 16. In yet another embodiment, said high water detection sensor 36 may further transmit or cause to be transmitted an audio, visual, digital, analog, or other warning, either directly or through a communications network, such as an internet, intranet, or other suitable system. In yet another embodiment, said high water detection sensor 36 uses a water contact or float switch for detecting high water. In yet another embodiment, said sensor 36 interfaces with an alarm system.

Referring again to FIGS. 1, 2, 3, 4, 6, 7, and 8, in other embodiments, said central control unit 16 may provide safety messages or warnings, via audible instruction, visual instruction, or other suitable means, when authorized personnel activate the hatch system 10 or enter the access port 12, wherein the entry may be detected using a proximity sensor 47. In yet another embodiment, the central control unit may have a volume setting for controlling the volume of its audible messages.

Referring again to FIGS. 1, 2, 3, 4, 6, 7, and 8, in other embodiments, sound speakers 23A, 23B, and 23C are provided that may reside in the keypad control unit 20 or emergency control switchbox 17, at ground level or in the ingress/egress area independently or within the central control unit 16 and/or located outside mounted on the safety rail 28 or weather alert tower 88.

Referring again to FIGS. 1, 3, and 6, in other embodiments, an emergency switching station 17, of the glass break type, for convenient and visible storage, is provided for operational control, via direct or indirect communication with the central control unit 16, of said electronically controlled hatch system 10 and may house interior activation and deactivation switching 18, a keypad 24, and a plurality of handheld remote control units/fobs 21.

Referring again to FIG. 6, in yet another embodiment, a manually actuatable test system is provided, wherein activating of a test button 25 instigates the performance of steps to detect whether or not a hazardous condition exists or does not exist and that all systems are functioning properly.

Referring again to FIG. 4, in other embodiments, a gas detector 40 is provided and may interface with the central control unit 16 to detect dangerous levels of gas, such as smoke, carbon monoxide, etc., activate an alarm, such as an audible alarm, visual alarm, digital or analog warning message, or other warning communication, in response to detecting the dangerous levels of gas, and to alert nearby personnel that there is a potential gaseous hazard or fire. In yet another embodiment, said detector 40 may be integrated into the building's alarm or primary security system. In yet another embodiment, the gas detector 40 may include a photoelectric and/or ionization smoke detector for detecting smoke and potential fire hazards. In yet another embodiment, the gas detector 40 may include a carbon monoxide detector for detecting the presence of the toxic gas carbon monoxide (CO).

Referring again to FIG. 4, in yet other embodiments, an interior thermostat 43 is provided to sound an alert for potential dangerously high temperatures, preferably at thermostat set at or around 130° or higher.

Referring again to FIGS. 1 and 8, in yet other embodiments, an outside thermometer and hygrometer is located in weather sensor housing 81 to provide to alert for dangerous temperature extremes and also taking into considerations wind speed to calculate potentially dangerous wind chill conditions as well a dangerous high temperatures including the hygrometer to measure humidity levels for heat index calculations.

Referring again to FIGS. 1 and 8, in yet other embodiments, a rain, ice, snow detector 105 is provided, which sounds an alert, via interface with the central control unit 16 or independently, if hatch lid 11 is inadvertently left open and it begins to rain. In yet other embodiments, said detector 105 may transmit rain, ice, and/or snow measurements to said central control unit 16 for computing load calculations and transmitting such information over a communications network to personnel for safety concerns related to the structural integrity of the roof or other surface.

Referring again to FIGS. 1 and 8, in yet other embodiments, an anemometer 80 is provided to measure high wind pressure or the wind velocity and report such information to the central control unit 16 for processing of said information, and transmitting it to a readout or keypad readout 22, and/or sounding audible alarms (23A, 23B and 23C) and/or activating a visible warning light 103, whereupon personnel can view the information prior to ingress or egress through the access port 12. In yet other embodiments, the central control unit 16 may limit operation of the hatch 11 at such times when the wind gusts exceed safe speeds for opening or closing of the hatch 11. In yet other embodiments, the anemometer 80 may communicate directly with an independent alarm system and/or an alarm system of a building or other structure.

Referring again to FIGS. 1, 3, and 8, in yet other embodiments, an excess snow load detector 35 is provided for detecting excess snow and/or ice, processing the information, via internally or within the central control unit 16, to determine the approximate weight of the snow and/or ice on the roof for activation of an alert if the weight of the snow and/or ice exceeds a predetermined maximum weight for the roof. Said excess snow load detector 35 may be mounted on the exterior of the roof area, and may communicate, via hard wire or wirelessly, to the central control unit 16, wherein said central control unit may transmit the communication to the keypad control unit 20, alerting of the potential danger, and/or may activate an alarm, such as an audible alarm, visual alarm, digital or analog warning message, or other warning communication to personnel notifying them of the dangers snow and/or ice. In yet other embodiments, the excess snow load detector 35 may communicate directly with an independent alarm system and/or an alarm system of a building or other structure.

Referring again to FIGS. 1 and 8, in yet other embodiments, a lighting detector 84 is provided, may be mounted to the exterior of the roof area preferably towards the top of the grab post 91L or 91R and/or weather advisory tower 88L or 88R, and may communicate, via hard wire or wirelessly, to the central control unit 16, wherein said central control unit may transmit the communication to the keypad control unit 20, alerting of the potential danger, and/or may activate an alarm, such as an audible alarm, visual alarm, digital or analog warning message, or other warning communication to personnel notifying them of the dangers of nearby lightning. In yet other embodiments, the lighting detector 84 may communicate directly with an independent alarm system and/or an alarm system of a building or other structure.

It should be further noted that any or all sensors/detectors or devices, such as the gas detector, anemometer, lightning detector, thermometer, thermostat, etc., as described herein, of the electronically controlled hatch system 10 may be implemented to interface or otherwise communicate via hard wire or wirelessly to the central control unit 16, wherein said central control unit may process the communication and/or transmit the communication to the keypad control unit 20, for user notification purposes, and/or may activate an alarm, such as an audible alarm, visual alarm, digital or analog warning message, or other warning communication, including internet, intranet, telephonic, or other suitable communication system. It should be further noted that any or all sensors/detectors or devices, such as the gas detector, anemometer, lightning detector, thermometer, thermostat, etc., as described herein, of the electronically controlled hatch system 10 may be implemented to communicate directly, via hard wire or wirelessly, with an independent alarm system, an alarm system of a building or other structure, and/or any other suitable communication network, such as the Internet. In yet other embodiments, any or all sensors/detectors or devices, such as the gas detector, anemometer, lightning detector, thermometer, thermostat, etc., as described herein, of the electronically controlled hatch system 10 may trigger a communication, directly or indirectly to the central control unit 16, an alarm, or any other warning or communication system, by measuring, sensing, detecting, or reading information that matches a pre-set condition of the sensor or device. In yet another embodiment, the central control unit 16 may receive outside information, such as an alert by the National Weather Service, via radio, internet, intranet, telephonic system, or other suitable means, and/or record and/or deliver said outside information to personnel.

Referring again to FIG. 8, in yet another embodiment, an external hatch grab post 88R is provided with a preferred access exterior keypad control unit 83 or key switch to open and close the hatch 11. This post 88R (or 88L) would also support a one or a plurality of additional monitoring security, safety, weather, and other hazard sensors or devices, such as weather sensor housing 81, high water detection sensor 36, wind speed anemometer 80, lightning detectors 84, exterior motion detectors 101, beacon-strobe light 103, audible alarms 23C, photovoltaic panels 86, receiving and transmitting antennas 104, CCTV equipment 102, and communications dishes.

In yet other embodiments, a method is provided for operating a safety egress/ingress system 10. The method may comprise receiving a plurality of hazard indications, identifying the type of hazard, determining safe condition of egress/ingress, at least in part by comparing the level or type of hazard indications to pre-set conditions, operation of hatch 11, and operation of safety rail 28.

Referring again to FIGS. 1 and 6, in yet other embodiments, a method is provided to aide in safe egress of a structure, wherein warning indicators lights 19 and or text displays 22 are co-located within or near an interior safety protection access keypad control unit 20 or other operational switch, which may be positioned near base of access ladder 96, interior wall, or other suitable structure. Sensors for detecting various hazards, security, and/or safety information, as described herein, are mounted at or near hatch 11 to provide detection of hazards, security, and/or safety information in proximity to hatch system 10. Upon detection of hazards, security, and/or safety information by said sensors, transmission of information concerning said hazards, security, and/or safety information to a central control unit 16, processing of said information by said central control unit 16 for display on said warning indicators lights 19 and/or said text displays 22, displaying of warning messages on warning indicators lights 19 and/or text displays 22, and review and analysis of the hazard, security, and/or safety information, the operator or software in the central control unit 16 may then determine whether or not to continue operation of the hatch system for egress/ingress through said access port. In yet other embodiments, once the operator deems the situation to be safe and clear for egress, the operator, standing at ground level, may enter a passcode into the keypad control unit 20 or a standard key may be inserted therein, granting access to the access port 12 or causing a relay switch to activate the central control unit 16, which will deactivate any alarm or lockout system, illuminate an egress light 15, and facilitate operation of the electronically controlled hatch system 12.

In yet other embodiments, when hazard, security, and/or safety conditions are deemed acceptable, the operator may use the keypad 24 to deactivate the security alarm located in the central control unit 16 or 16B, activate the egress/ingress hatch 11 by actuators 26L and 26R or 26A, activate the protractile/retractable safety rail 28, and activate an egress/ingress pathway light 15.

In yet other embodiments, once personnel have ascended to the exterior surface deck 14 they may now chose to close the hatch 11 and subsequently open the hatch 11 with a remote radio control fob 21, as illustrated in FIGS. 1 and 8, or personnel may use an exterior keypad control unit 83, which may be fixed to a safety grab post 91R or other suitable location. The safety grab post 91R with exterior keypad control unit 83 may also comprise a plurality of detection circuitry, such as lightning detector 84, rain, snow, and/or water sensor 105, float switch high water detection sensor 36, excessive snow sensor, potential ice thermometer, high wind anemometer 80, audible warnings devices 23C, warning beacon-strobe light 103, or other devices and/or sensors located on the grab post 91R, including solar photovoltaic panels 86B, antennas 104 and 82, communications dishes, closed-circuit television (CCTV) cameras 102, swing gate 90, and the like. A second safety grab post 91L may also be provided for functions described for the first safety grab post 91R.

In yet another embodiment, the present invention additionally encompasses a method that may include detecting hazard, security, or safety information, wire and or wirelessly notifying a centralized controller 16 of the information, receiving a message from the centralized controller 16 in response to the information, and operating the egress/ingress hatch 11 and safety rail 28 based on the received message, and/or activating the necessary alarms or warnings, such as warning indicators lights 19 and or text displays 22.

Thus, it is apparent that there has been provided, in accordance with the present invention, a safety protection system and corresponding methods of safe egress. Although embodiments of the integrated safety rail protection system have been described in detail, those skilled in the art will also recognize that various substitutions and modifications may be made without departing from the scope of the appended claims, even if, for example, all of the advantages and benefits identified above are not present. For example, the various elements or components may be combined or integrated in an alternative system or certain features may not be implemented. Also, the systems, sub-systems, switches, sensors, contacts, power sources, and methods described and illustrated in the preferred embodiment as discrete or separate may be combined or integrated with other systems, techniques, or methods without departing from the scope of the present invention. For example, the keypad control unit 20 and central control unit 16 could be replaced by a personal computer (PC), or other suitable computer, wherein the PC may activate or deactivate any or all of the safety protection system functions or monitors, record sensor readings, or with proper authorization could access, control and monitor, via a secure internet or intranet line, the operations of the safety hatch system 10. In other embodiments, personnel could access, control, and monitor the hatch system 10, via a cellular telephone or other suitable device, using text message commands, voice recognition commands, or the like. In other embodiments, user authorization could be by way of passcode, facial, fingerprint, retina recognition or any other authorization system.

Further, each such component may be made of the same or different materials and still fall within the scope of the present invention. Other examples of changes, substitutions, and alterations are readily ascertainable by one skilled in the art and could be made without departing from the scope of the present invention.

Additionally, all surfaces of the electronically controlled hatch system 10 may be knurled for grip, which includes surface texturing, surface projections, textured paint or powder coating, textured grip tape, or any other method of surface texturing to aid in gripping by a user's hands or feet.

It should also be noted that in addition to being engineered and designed to cost effectively retrofit existing hatch ways/access ports, the electronically controlled hatch system 10 may also be built new as a complete hatch protection system for access ports or other building structure entryways.

What is claimed is:

1. An electronically controlled hatch system for use with a hatch to limit entry and exit through an access port for ingress or egress, said hatch system comprising:

an actuator cooperable with said hatch and having an actuator arm, the actuator operable to effectuate locking or unlocking the hatch and moving said hatch to at least an open position or a closed position;

a central control unit operable to communicate with the actuator to position the hatch; and a mechanical latching system, wherein the mechanical latching system is cooperable with said actuator arm to lock or unlock the hatch, the mechanical latching system comprising:

a lock mechanism including a locking bolt, wherein the locking bolt is operable to be actuated to perform one of locking the lock mechanism to secure the hatch in the closed position or unlocking the lock mechanism to permit moving the hatch from the closed position to the open position;

a clevis bracket operable to be coupled to the hatch and having a bracket opening therethrough;

a pivot plate positioned adjacent the clevis bracket and having a pivot opening therethrough, the pivot plate operable to interface with the actuator arm to effectuate locking or unlocking the lock mechanism;

a pivot pin passing through the bracket opening and the pivot opening and operable to allow the pivot plate to movably pivot thereupon; and a pivot rod having a first end coupled to the pivot plate and a second end coupled to the lock mechanism, the pivot rod operable to actuate the locking bolt to lock or unlock the lock mechanism;

wherein movement of the actuator arm in a first direction causes limited, responsive movement of the pivot plate to effectuate movement of the pivot rod in a second direction such that the pivot rod actuates the locking bolt to unlock the lock mechanism without moving the hatch to the open position, and continued movement of the actuator arm in the first direction moves the hatch from the closed position to the open position after the lock mechanism is unlocked, and wherein movement of the actuator arm in the second direction moves the hatch from the open position to the closed position.

2. The electronically controlled hatch system of claim 1, wherein movement of the actuator arm in the second direction also causes limited, responsive movement of the pivot plate to effectuate movement of the pivot rod in the first direction such that the pivot rod actuates the locking bolt to lock said lock mechanism.

3. The electronically controlled hatch system of claim 1, further comprising an electronic latching system operable for interfacing said hatch with said access port.

4. The electronically controlled hatch system of claim 1, further comprising a control unit operable to electronically communicate with the central control unit to control the actuator.

5. The electronically controlled hatch system according to claim 4, wherein said control unit is wireless.

6. The electronically controlled hatch system of claim 1, further comprising an egress light positioned adjacent to the access port, wherein said egress light automatically operates to illuminate the access port when said hatch is not in the closed position.

7. The electronically controlled hatch system of claim 1, further comprising an emergency switching station for operating said electronically controlled hatch system in an emergency situation.

8. The electronically controlled hatch system of claim 1, further comprising a power source capable of at least partially powering said electronically controlled hatch system, wherein said power source is selected from the group consisting of a photovoltaic solar panel, a battery, and a fuel cell.

9. The electronically controlled hatch system of claim 1, further comprising a sensor for acquiring information and communicating the information to said central control unit, wherein said sensor is selected from the group consisting of a gas detector, anemometer, lightning detector, thermometer, thermostat, rebound sensor, high water detection sensor, motion sensor, smoke detector, excess snow load detector, hygrometer, snow detector, rain detector, and ice detector.

10. The electronically controlled hatch system according to claim 9, wherein said sensor is positioned adjacent to said access port.

11. The electronically controlled hatch system according to claim 9, wherein said sensor communicates directly with an alarm system.

12. The electronically controlled hatch system of claim 1, further comprising an alarm capable of triggering in response to a preset condition.

13. The electronically controlled hatch system according to claim 12, wherein said alarm electronically interfaces with a communications network in response to a preset condition.

14. The electronically controlled hatch system of claim 1, wherein said central control unit interfaces with an Internet Protocol communications network.

15. The electronically controlled hatch system of claim 14, wherein the Internet Protocol communications network includes at least one of an Internet or an intranet network.

16. The electronically controlled hatch system of claim 1, wherein said central control unit includes two discrete processing units.

17. The electronically controlled hatch system of claim 1, further comprising a surveillance camera for monitoring conditions adjacent to said access port.

18. The electronically controlled hatch system according to claim 17, wherein said surveillance camera interfaces with said central control unit.

19. The electronically controlled hatch system according to claim 17, wherein said surveillance camera interfaces with an alarm system.

20. The electronically controlled hatch system of claim 1, further comprising a generally vertical tower rail positioned adjacent to said access port for mounting equipment.

21. The electronically controlled hatch system of claim 1, further comprising at least one safety rail mounted adjacent the access port, wherein said safety rail includes a gate for limiting ingress and egress through said hatch system.

22. The electronically controlled hatch system of claim 21, wherein said gate is self-closing.

23. The electronically controlled hatch system of claim 21, wherein said safety rail includes a grab hold projection extending at an angle offset from vertical.

24. An electronically controlled hatch system for use with a hatch to limit entry and exit through an access port for ingress or egress, said hatch system comprising:

an actuator cooperable with said hatch and capable of raising or lowering said hatch to at least one of an open position or a closed position;

a central control unit operable to communicate with the actuator to position the hatch;

a hatch position sensor operable to detect at least the open position and the closed position of the hatch, wherein the hatch position sensor is operable to communicate with the central control unit; and a mechanical latching system cooperable with said actuator for interfacing said hatch with said access port, wherein said mechanical latching system comprises:

a lock mechanism operable to be coupled to the hatch and including a locking bolt, wherein the locking bolt is operable to be actuated to perform one of locking the lock mechanism or unlocking the lock mechanism;

a clevis bracket operable to be coupled to the hatch and having a bracket opening therethrough;

a pivot plate, having a pivot opening therethrough, positioned adjacent the clevis bracket;

a pivot pin passing through the clevis bracket opening and the pivot opening and operable to allow the pivot plate to movably pivot thereupon;

an actuator arm, wherein the actuator arm interfaces with said actuator and said pivot plate; and a pivot rod having a first end coupled to the pivot plate and a second end coupled to the lock mechanism, the pivot rod operable to actuate the locking bolt to lock or unlock the lock mechanism;

wherein movement of the actuator arm in a first direction causes limited, responsive movement of the pivot plate, which causes the pivot rod to move in a second direction such that the pivot rod actuates the locking bolt to unlock the lock mechanism without moving the hatch to the open position, and continued movement of the actuator arm in the first direction moves the hatch from the closed position to the open position after the lock mechanism is unlocked; and wherein movement of the actuator arm in the second direction moves the hatch from the open position to the closed position.

25. The electronically controlled hatch system of claim 24, wherein movement of the actuator arm in the second direction also causes limited, responsive movement of the pivot plate to effectuate movement of the pivot rod in the first direction such that the pivot rod actuates the locking bolt to lock said lock mechanism.

26. The electronically controlled hatch system of claim 24, wherein the central control unit interfaces with an Internet Protocol communications network.

27. The electronically controlled hatch system of claim 26, wherein the Internet Protocol communications network includes at least one of an Internet or an intranet network.

28. The electronically controlled hatch system of claim 24, further comprising at least one safety rail mounted adjacent to said access port.

* * * * *